US008651596B2

(12) United States Patent
Fukui

(10) Patent No.: US 8,651,596 B2
(45) Date of Patent: Feb. 18, 2014

(54) IMAGE FORMATION APPARATUS

(75) Inventor: Atsushi Fukui, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 129 days.

(21) Appl. No.: 13/075,616

(22) Filed: Mar. 30, 2011

(65) Prior Publication Data

US 2012/0074824 A1 Mar. 29, 2012

(30) Foreign Application Priority Data

Sep. 28, 2010 (JP) ..... 2010-217183

(51) Int. Cl.
*B41J 29/02* (2006.01)
*E05C 3/12* (2006.01)

(52) U.S. Cl.
USPC ..... 312/326; 292/195; 292/45; 292/220

(58) Field of Classification Search
USPC ..... 399/107, 125; 292/11, 13, 24, 25, 31, 292/44, 45, 54, 95, 101, 102, 103, 108, 218, 292/219; 361/726, 732, 741, 759, 616, 617, 361/679.58, 679.43; 70/27, 78, 85, 25, 29, 70/45, 159
See application file for complete search history.

(56) References Cited

U.S. PATENT DOCUMENTS

2005/0269923 A1* 12/2005 Kim ..... 312/401
2006/0230795 A1* 10/2006 Kroening ..... 70/159
2007/0098441 A1* 5/2007 Oohata et al. ..... 399/122

FOREIGN PATENT DOCUMENTS

JP 02-133049 11/1990
JP 2000-098681 4/2000
JP 2006-030219 2/2006

OTHER PUBLICATIONS

Notification of First Office Action issued in corresponding Chinese Patent Application No. 201110085357.0 dated Nov. 22, 2013.

* cited by examiner

*Primary Examiner* — Clayton E Laballe
*Assistant Examiner* — Victor Verbitsky
(74) *Attorney, Agent, or Firm* — Banner & Witcoff, Ltd.

(57) ABSTRACT

An image formation apparatus is provided with a housing, a rockable member rockably secured to the housing, and a lock mechanism including an engaging portion and an engageable portion. The rockable member is locked to the housing when the engageable portion is engaged with the engaging portion. The image formation apparatus is further provided with a displaceable guide member secured to the housing or the rockable member. A guiding member is provided to the housing or the rockable member. The guiding member slide-contacts the guide member when the rockable member rocks so that the state of the rockable member is changed from a rockable state to an unrockable state. The engageable portion is displaced to move closer to the engaging portion in a case where the guide member contacts the guiding member than in a case where the guide member does not contact the guiding member.

10 Claims, 6 Drawing Sheets

IMAGE FORMATION APPARATUS

CROSS-REFERENCE TO RELATED APPLICATION

This application claims priority under 35 U.S.C. §119 from Japanese Patent Application No. 2010-217183 filed on Sep. 28, 2010. The entire subject matter of the application is incorporated herein by reference.

BACKGROUND

1. Technical Field

Aspects of the present invention relate to an image formation apparatus.

2. Related Art

Conventionally, there has been known an image formation apparatus having an openable cover provided to its housing. Typically, such a cover is configured to rock in an up-and-down direction about an axis extending in a right-and-left direction of the housing so that the cover is located between open and close positions. To hold the cover at the close position, such a cover is provided with lock mechanisms on right and left portions. That is, on the right and left side portions of the cover, engaging members are provided, and corresponding engaging member are provided to the housing. When the cover is completely closed, the corresponding engaging members engage with each other. In order to detect that the cover is completely closed, a sensor is provided. In order to detect the closed state of the cover with one sensor, one of the right and left lock mechanisms is harder to be engaged than the other, and the sensor is provided to detect the harder engagement is done or not to determine whether the cover is completely closed or not.

SUMMARY

In the conventional image formation apparatus described above, one of the lock mechanisms is configured to lock harder than the other to detect whether the cover is closed completely or not. Because of such a configuration, the cover may not be closed completely. However, if the lock mechanisms are configured to lock easily with a less operational force, it is ensured that the cover is always closed completely.

The locking mechanisms which function with a small operational force may have a problem. That is, when the lock mechanism is configured such that the cover is locked easily, it also allows disengagement of the cover easily. That is, with a slight impact, the cover may be opened.

Aspects of the invention provide an image formation apparatus in which a rockable member such as an openable cover can be locked easily, and the locked condition will not be released easily.

According to aspects of the invention, there is provided an image formation apparatus, which is provided with a housing, a rockable member rockably secured to the housing, and a lock mechanism including an engaging portion and an engageable portion, the engaging portion being formed to one of the housing and the rockable member, the engageable portion being formed to the other of the housing and the rockable member, the engageable portion being engageable with the engaging portion, the engageable portion being displaceable with respect to the other of the housing and the rockable member, a separating force which causes the engageable portion to displace from the engaging portion being applicable to the engageable portion, the rockable member being locked with respect to the housing when the engageable portion being engaged with the engaging portion. The image formation apparatus is further provided with a guide member secured to the other of the housing and the rockable member, the guide member being displaceable, with respect to the other of the housing and the rockable member, integrally with the engageable portion, and a guiding member provided to the one of the housing and the rockable member, the guiding member slide-contacting the guide member to displace the guide member with respect to the other of the housing and the rockable member when the rockable member rocks so that the state of the rockable member is changed from a rockable state to an unrockable state. The engageable portion is displaced to move closer to the engaging portion in a case where the guide member contacts the guiding member than in a case where the guide member does not contact the guiding member.

BRIEF DESCRIPTION OF THE ACCOMPANYING DRAWINGS

DETAILED DESCRIPTION

Hereinafter, exemplary embodiments according to aspects of the present invention will be described with reference to the accompany drawings.

An image formation apparatus 1 (see FIG. 1) according to a first embodiment has a housing 3, which contains an image formation unit configured to form an image on a sheet such as a printing sheet or an OHP sheet in accordance with an electrophotographic image formation method. Since the electrophotographic image formation method and the image formation unit therefor are well known, detailed description thereof will be omitted for brevity.

In the image formation apparatus 1, an image (i.e., toner image) is transferred onto the sheet as the sheet is fed in the housing. In the following description, the moving direction of the sheet at a position where the toner image is transferred will be referred to as a sheet feed direction.

The housing 3 serves as a covering member which configure an appearance of the image formation apparatus 1. Functional components such as the image formation unit, sheet feed mechanism, etc. are secured to a frame accommodated in the housing 3.

Figure 1:
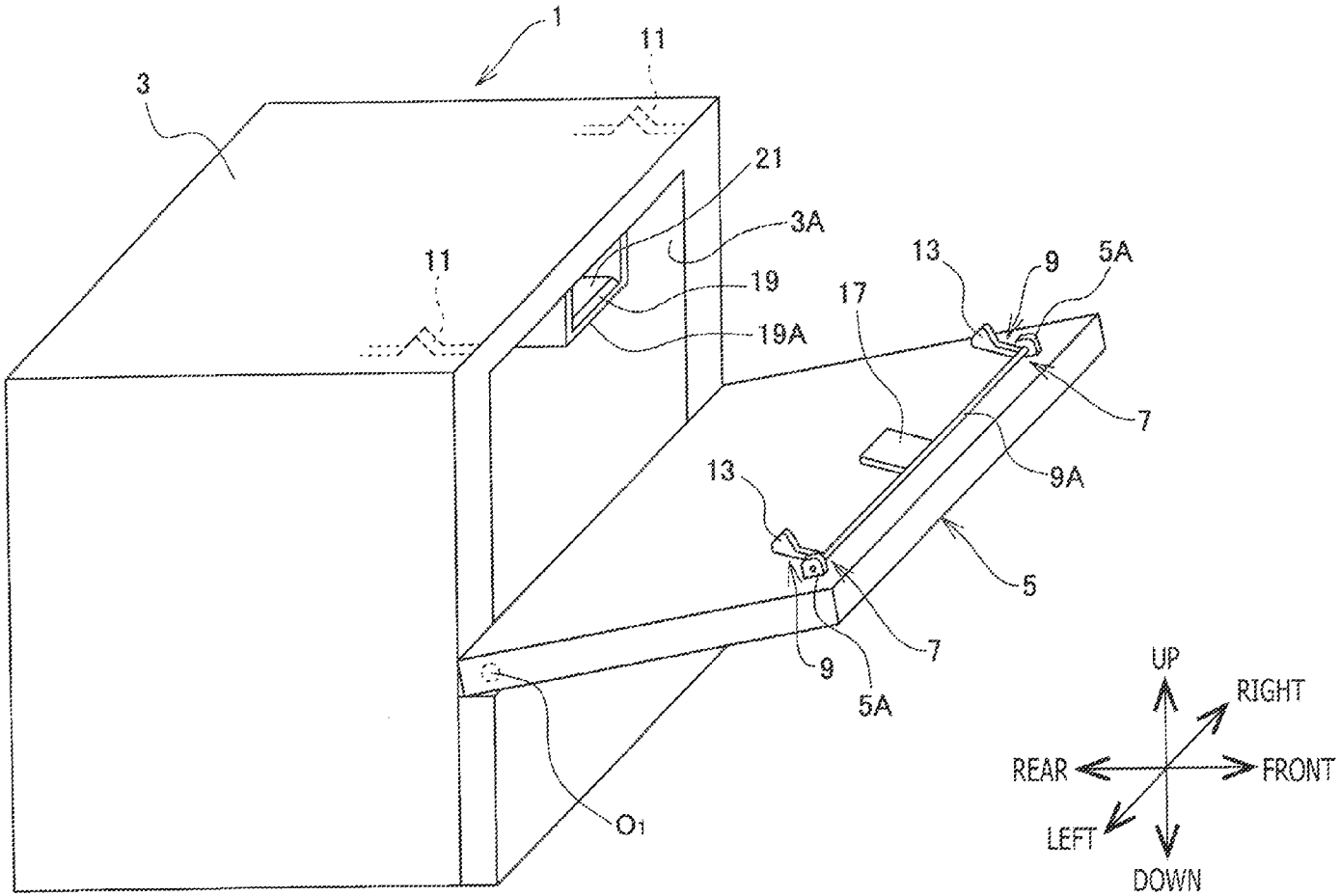
FIG. 1 is a perspective view of an image formation apparatus according to a first embodiment of the invention.

As shown in FIG. 1, the housing 3 has a substantially cubic shape, and an opening 3A which communicates inside/outside of the housing 3, and an openable cover 5 which is a rectangular plate is provided to open/close the opening 3A.

The openable cover 5 is rockably secured to the housing 3 such that the openable cover 5 rocks about an axis O1 using a hinge mechanism. An axis of the rocking movement about the hinge mechanism extends in the direction perpendicular to the sheet feed path (i.e., the right-and-left direction in the embodiment).

On an upper end of the openable cover, latch arms 9 which serve as a part of the lock mechanism 7 are secured. The lock mechanisms 7 are for maintaining a locked condition where the openable cover 5 cannot rock with respect to the housing 3 in order to maintain a closed state which is a state where the openable cover 5 closes the opening 3A.

Figure 5A:
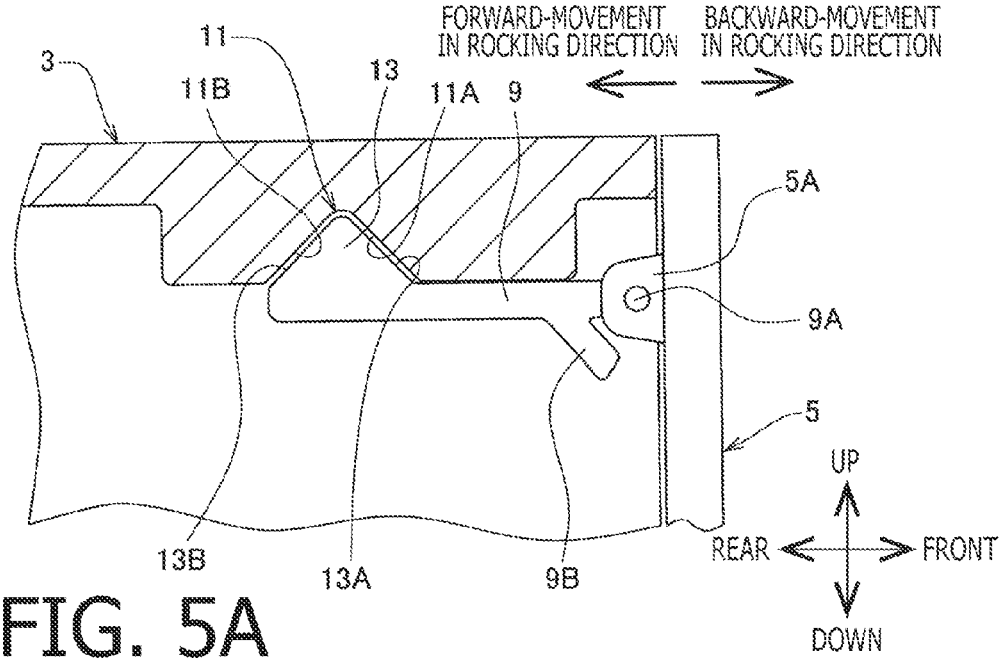
FIG. 5A is a chart illustrating an operation of a latch arm and protruded portion according to the first embodiment.

It should be noted that the upper end and the lower end of the openable cover 5 in this specification mean those when the openable cover 5 is in the closed state as shown in FIG. 5A. Further, in this specification, a forward-rock direction and a backward-rock direction are defined such that the forward-rock direction is a direction the openable cover 5 moves when the openable cover 5 is closed, while the backward-rock direction is a direction when the openable cover 5 is opened. Therefore, according to the first embodiment, the forward-rock direction corresponds to the sheet feeding direction.

The lock mechanisms 7 include a pair of concave portions 11 formed on an inner surface of the housing 3, a pair of latch arms 9 which are rockably secured to the openable cover 5 and configured to elastically deform on the housing side, and a pair of convex portions 13 formed to the pair of latch arms 9, respectively (see FIGS. 1 and 5A).

The concave portions 11 are formed to have depressed portions corresponding to the shape of the convex portions 13. Specifically, the concave portions 11 are depressed in the upper direction in the embodiment. Further, each of the concave portions 11 has engaging surface 11A and 11B, which intersect with each other, and each of the engaging surfaces 11A and 11B intersects with the rocking direction (i.e., the front and rear direction in this embodiment). The engaging surfaces 11A and 11B are parallel with the right-and-left direction.

At least the engaging surface 11A, which is the rear side of one of the two engaging surfaces 11A and 11B, is configured to incline such that a front side portion of the engaging surface 1A is closer to the bottom of the concave portion 11 in comparison with a rear side portion thereof (i.e., the front side portion of the engaging surface 11A is higher and the rear side portion is lower) with respect to the rocking direction. According to the embodiment, the engaging surfaces 11A and 11B form a reversed V-shape when viewed from the right-and-left direction.

A tip end portion, in the extending direction of the latch arm 9, of the convex portion 13 is protruded toward the concave portion 11 (i.e., protruded upward, according to the embodiment). The convex portion 13 is displaceable in the direction intersecting with the extending direction thereof (i.e., a circumferential direction about the rocking shaft 9A, according to the embodiment). As the convex portion 13 fits in the concave portion 11, the convex portion 13 and the concave portion 11 engage with each other and the openable cover 5 is held in the closed state.

The convex portion 13 is formed with engaging surfaces 13A and 13B which extend in the right-and-left direction. The engaging surfaces 13A and 13B are inclined such that the engaging surfaces 13A and 13B form a reversed V-shape when viewed from the right-and-left direction.

Since the convex portion 13 and the concave portion 11 are to engage with each other, at least the engaging surface 11A and the engaging surface 13A should be parallel with each other when the openable cover 5 is in the closed state. To ensure such a condition, according to the embodiment, the shape of the convex portion 13 and the concave portion 11 when viewed from the right-and-left direction is an isosceles triangle.

It is sufficient that the engaging surface 11B does not interfere with the engaging surface 13B when the convex portion 11 and the concave portion 13 engage with each other. Therefore, the engaging surfaces 13A and 13B need not be configured to extend symmetrically with respect to the protruding direction thereof. Thus, for example, the engaging surface 11B may be configured to be parallel with the protruding direction of the concave portion 13 (i.e., perpendicular to the rocking direction).

According to the embodiment, when the openable cover 5 is in the closed state, the convex portion 13 is located below the concave portion 11, with the convex portion 13 protruded upward and the convex portion 13 depressed upward. With such a configuration, gravity force applied to the convex portion 13 and the latch arm 9 act to move the convex portion 13 away from the concave portion 11 (hereinafter, such a force will be referred to as a separation force).

Figure 2B:
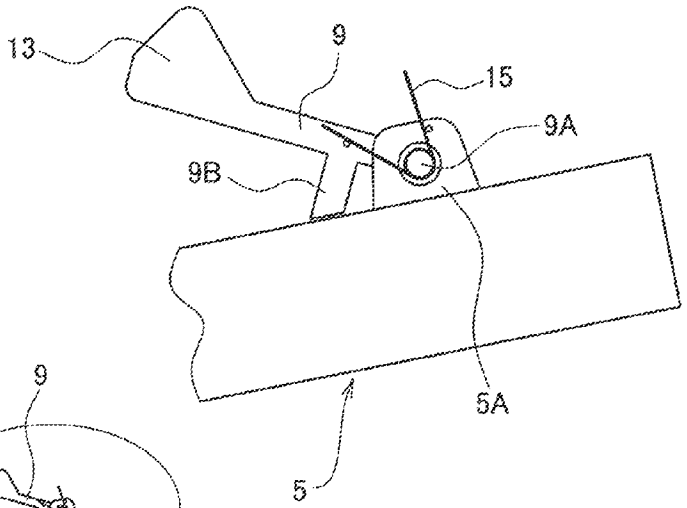
FIG. 2B is an enlarged side view of a latch arm (i.e., a circled portion in FIG. 2A).
Figure 2A:
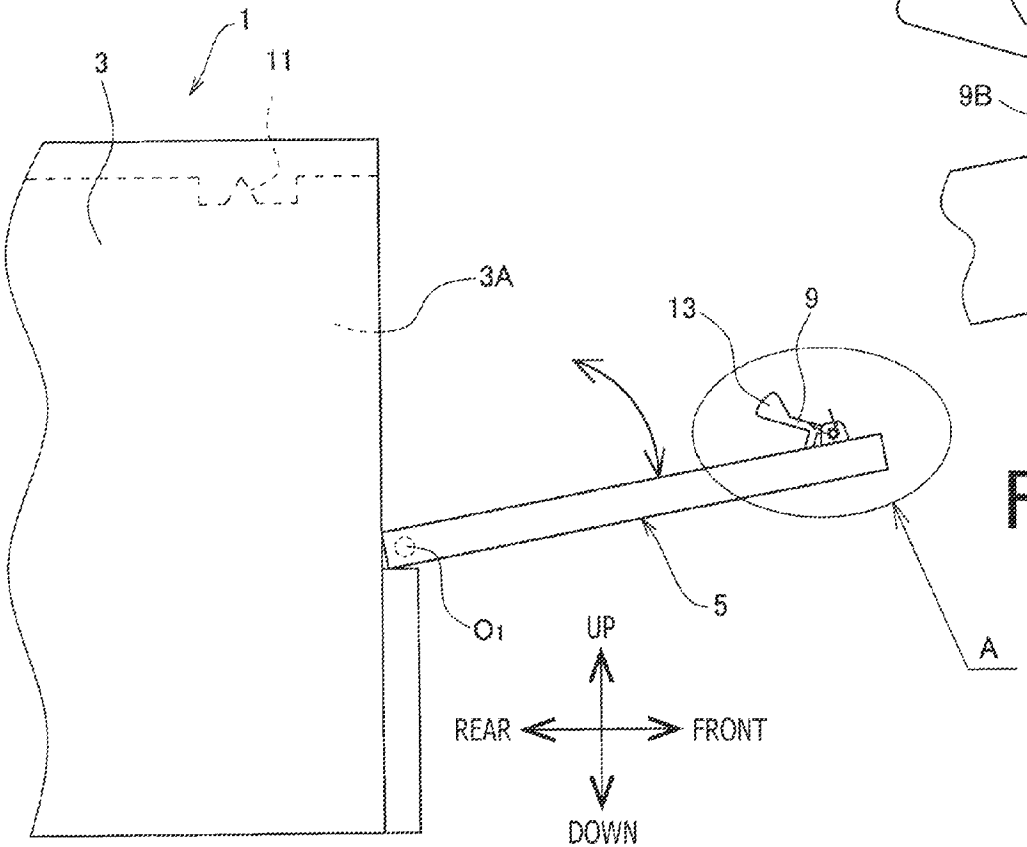
FIG. 2A is partial side view of the image formation apparatus shown in FIG. 1.

Further, according to the embodiment, at the central portion of the latch arm 9, a spring member such as a torsion spring 15 is provided so that the elastic force of the torsion spring 15 acts the latch arm 9 as the separation force (see FIG. 2B).

The lock mechanisms 7 are provided at a plurality of locations in the right-and-left direction with being separated from each other. According to the embodiment, as shown in FIG. 1, two lock mechanisms 7 are provided (i.e., a left side one and a right side one). The lock mechanisms 7 have the same concave portion 11, convex portion 13, latch arm 9 and torsion spring 15. When the openable cover 5 is moved to close, the lock mechanisms 7 operate at the same time. Since the plurality of lock mechanisms 7 have the same structure, the structure of one lock mechanism 7 will be described in detail hereafter.

The rocking shaft 9A of the latch arm 9 is formed to be unitarily with the latch arm 9 so that it rocks (rotates) unitarily with the latch aim 9. The latch arms 9 are secured at both ends of the rocking shaft 9A. According to the embodiment, the rocking shaft 9A and right and left protrusions 13, and the latch arm 9 are formed of resin, with an integral molding.

At right and left ends of the openable cover 5, bearings 5A are provided to rotatably support the rocking shaft 9A (see FIG. 2B). As the rocking shaft 9A rotates, the latch arms 9, and thus the convex portions 13) rockably displace.

At the central position between the adjoining right and left protrusions 13 (latch arms 9), that is, at the longitudinal center of the rocking shaft 9A, a guide member 17, which also rockably displaces with respect to the openable cover, together with (integrally with) the latch arms 9 (protrusions 13) is provided. According to the embodiment, the guide member 17 is also formed integrally with the rocking shaft 9A with the integral molding.

Figure 3A:
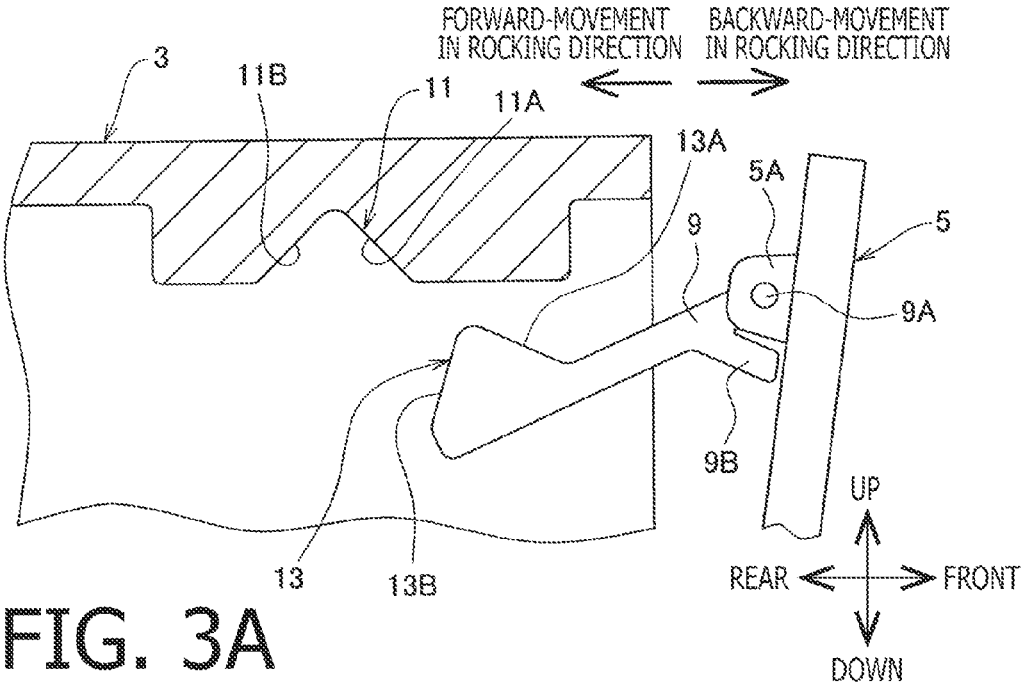
FIG. 3A is a chart illustrating an operation of a latch arm and protruded portion according to the first embodiment.

Since the guide member 17 protrudes from the openable cover 5 toward the housing 3 (opening 3A) similarly to the latch arms 9, the own weight and elastic force acting on the guide member 17 serves as the separation force. Therefore, when the openable cover 5 is opened, the latch arms 9 and the guide member 17 tend to rock and displace so as to approach the openable cover 5 as shown in FIGS. 3A and 3B.

Figure 3B:
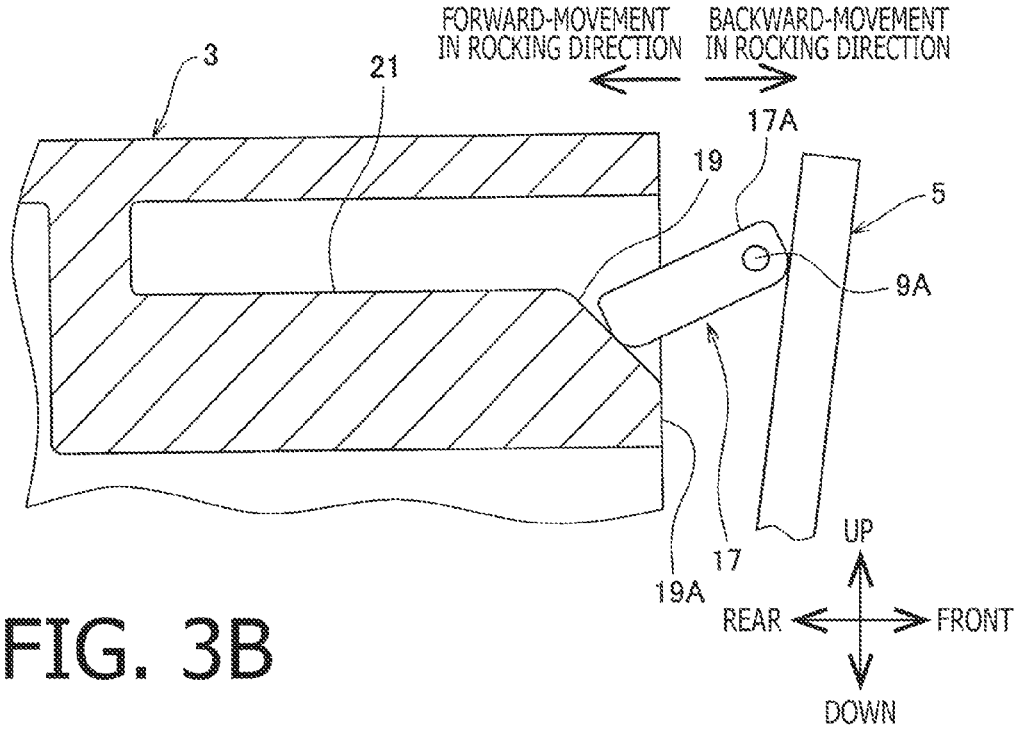
FIG. 3B is a chart illustrating an operation of a guiding member according to the first embodiment.

In the housing 3, there is formed an inclined guide surface 19 which slidably contacts the tip end of the guide member 17 when the openable cover 5 is moved from the opened and rockable state to the closed state (see FIG. 3B). The inclined guide surface 19 is formed such that its front side in the rocking direction is higher than its rear side.

When the openable cover is moved from its closed state to its opened state and the tip end of the guide member 17 contacts the inclined guide surface 19, as shown in FIG. 3B and FIG. 3B in this order, the tip end of the guide member 17 is guided by the inclined guide surface 19 and lifted up toward the concave portion 11. In accordance with the above movement of the guide member 17, the latch arms 9 displace toward the concave portion 11 in association with the displacement of the guide member 17 as shown in FIG. 3A and FIG. 4A in this order.

Figure 4A:
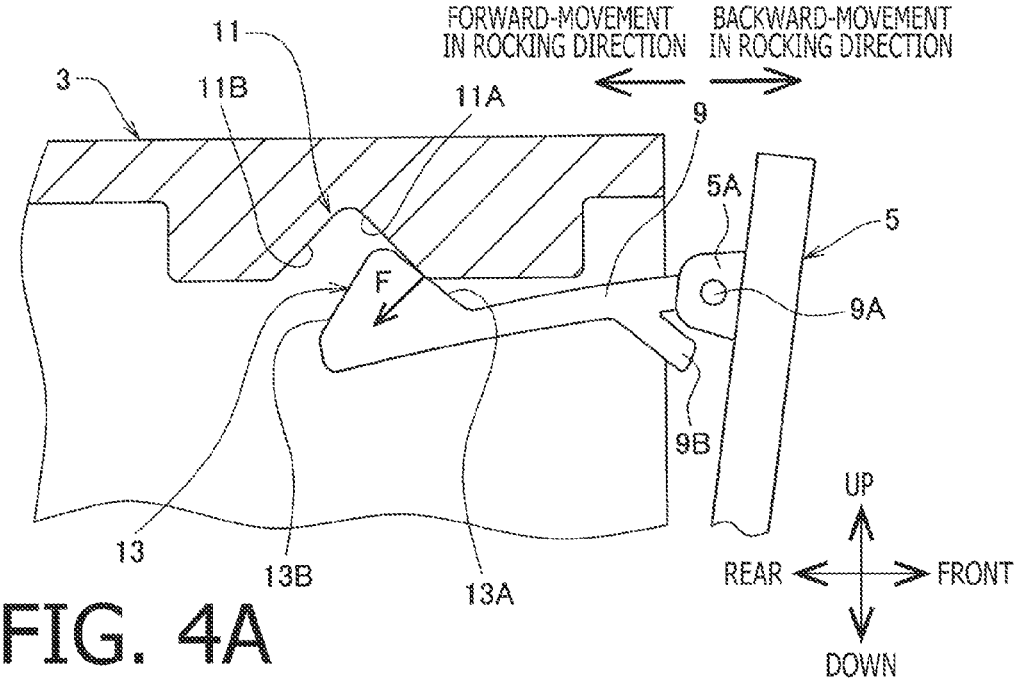
FIG. 4A is a chart illustrating an operation of a latch arm and protruded portion according to the first embodiment.

As described above, the inclined guide surface 19 makes the guide member 17 rockably displace so that the tip end of the guide member 17 is moved away from the openable cover 5, thereby the convex portions 13 being displaced from a position where the convex portion 13 is separated from the concave portion 11 (see FIG. 3A) to a position where the convex portion 13 is close to the concave portion 13 (FIG. 4A).

When the openable cover 5 has become in the closed state and the convex portion 13 and the concave portion 11 have engaged with each other, the guide member 17 is moved from the inclined guide surface 19 to the holding surface 21, from which the guide member 17 receives a force opposite to the separating force (i.e., reaction force).

At this stage, since the holding surface 21 is configured to be parallel with the rocking direction or inclined oppositely to the inclined guiding surface 19, the closed state is maintained unless a relatively large force for opening the openable cover 5 is applied.

If the force for opening the openable cover 5 is applied when the openable cover 5 is in the closed state, and the openable cover 5 is rocked to be opened, the guide member 17 is separated from the holding surface 21 and the inclined guiding surface 19. Then, the reaction force is lost and the guide member 17 and the latch arms 9 (convex portions 13) rock to displace in the direction where they are separated from the concave portions 11.

Thus, when the guide member 17 contacts the inclined guiding surface 19, the convex portions 13 displaces to be closer to the concave portion 11 in comparison with a state where the guide member 17 does not contact the inclined guiding surface 19.

If the openable cover 5 is moved toward the closed position when the guide member 17 contacts the openable cover 5, the upper surface 17A of the guide member 17 might contact the side surface 19A which is connected from the lower end of the inclined guiding surface 19 (see FIG. 3B). If the upper surface 17A contacts the side surface 19A, it becomes impossible to make the guide member 17 contact the inclined guiding surface 19. In the embodiment, in order to avoid such a sate, a positioning protrusion 9B is provided to the latch arm 9 so that the guide member 17 contacts the inclined guiding surface 19 without fail.

To the guide member 17 and the latch arm 9, the separating force is always applied. Therefore, when the guide member 17 does not contact the inclined guiding surface 19, the convex portions 13 are separated from the convex portions 11.

When the openable cover 5 is moved from the opened position toward the closed position and the guide member 17 starts contacting the inclined guiding surface 19 (see FIG. 3B), the convex portions 13 start displacing toward the convex portions 11 (see FIG. 3A).

Figure 4B:
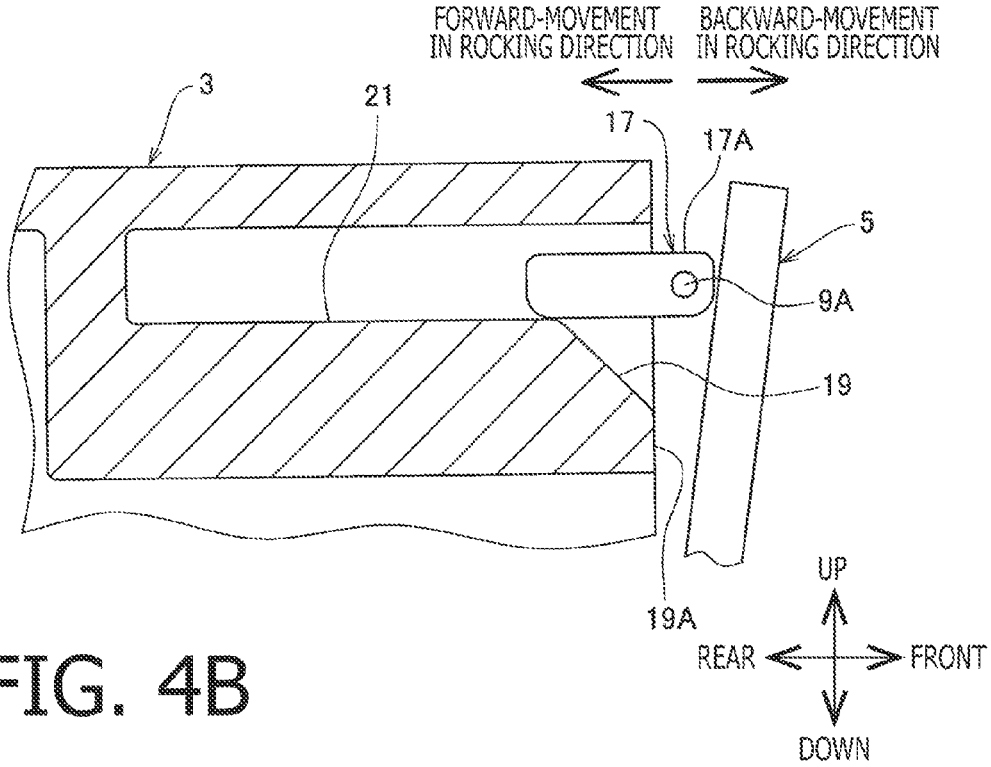
FIG. 4B is a chart illustrating an operation of a guiding member according to the first embodiment.
Figure 5B:
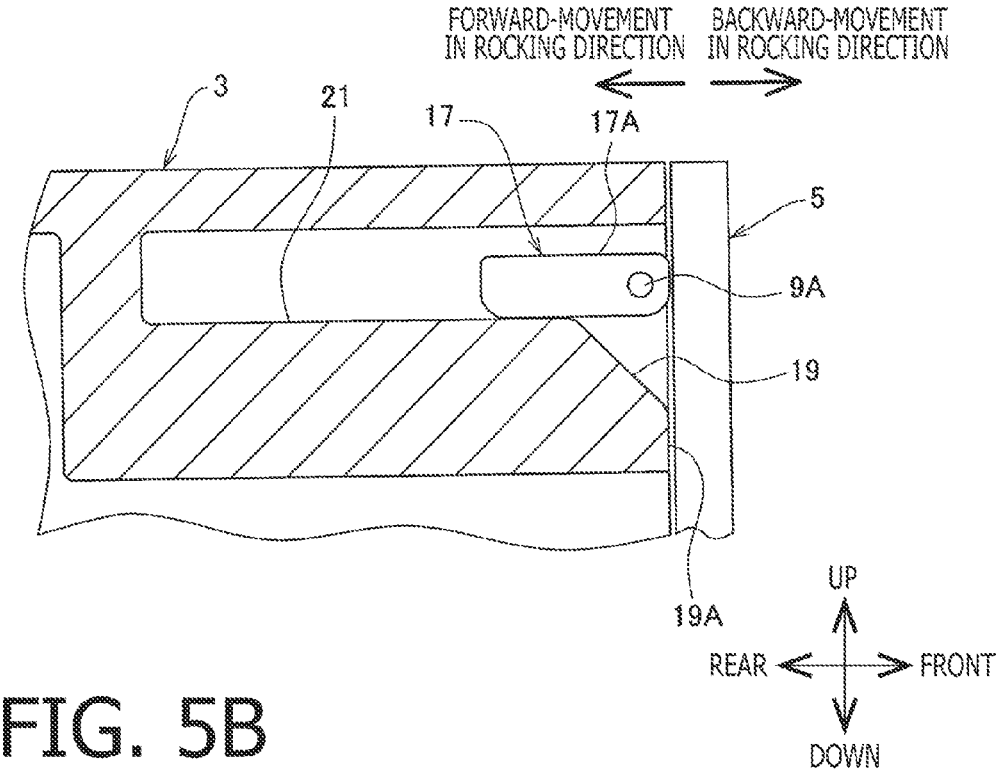
FIG. 5B is a chart illustrating an operation of a guiding member according to the first embodiment.

As the tip of the guide member 17 climbs up the inclined guiding surface 19 with contacting the same toward the concave portion 11 (see FIG. 4B), the convex portion 13 and the concave portion 11 start engaging (see FIG. 4A). When the guide member 17 has completely climbed up the inclined guiding surface 19 (see FIG. 5B), the engagement between the convex portion 13 and the concave portion 11 has completed (see FIG. 5A).

When the convex portion 13 and the concave portion 11 start contacting, flexural deformation of the latch arm 9 occurs due to force F generated at the contacting point between the concave portion 11 and the convex portion 13. The force F causes moment of rotating the latch arm 9 such that the convex portion 13 moves away from the concave portion 11 (hereinafter, such moment will be referred to as flexural moment) act on the latch arm 9 and the rotational shaft.

Since the rotation shaft 9A and the guide member 17 are integrated, the flexural moment is received by the contacting portion between the guide member 17 and the inclined guiding surface 19 or holding surface 21. Therefore, it is not necessary to operate the openable cover 5 against the flexural moment directly.

Therefore, the force to move the openable cover 5 (hereinafter, referred to as an operational force) corresponds to the frictional force generated at a position where the guide member 17 and the inclined guiding surface 19 or the holding surface 21 contact, and the frictional force generated at the position where the engaging surface 11A and the engaging surface 13A contact.

According to the present embodiment, the guide member 17, the inclined guiding surface 19 and the holding surface 21 are made of resin having relatively low frictional index (e.g., POM). Since the frictional force is sufficiently low, the operational force to open/close the openable cover 5 is relatively low.

As described above, when the openable cover is moved from the opened position toward the closed position, the guide member 17 starts displacing as it contacts the inclined guiding surface 19. In association with this movement, the convex portion 11 starts displacing to approach the concave portion 11. Finally, the convex portion 13 and the concave portion 11 engage with each other and the openable cover 5 is locked at the closed position.

According to the above-described embodiment, the inclined guiding surface 19 is used as a cam surface in association with the guide member 17 to displace the convex portion 13 toward the concave portion 11. Therefore, in comparison with a typical conventional lock mechanism in which a convex portion is elastically engaged with/disengaged from a concave portion, the operational force to move the openable cover can be reduced.

According to the above-described embodiment, when the concave portion 11 and the convex portion 13 are engaged with each other, the guide member 17 is in an unmovable state as it contacts the inclined guiding surface 19 or the holding surface 21 (the embodiment being configured that the guide member 17 contacts the holding surface 21). Therefore, the convex portion 13, which is configured to displace in association with the guide member 17, is also unmovable with respect to the engaging portion. Thus, the engaged state between the concave portion 11 and the convex portion 13 is firmly held.

According to the embodiment, the openable cover 5 can be locked at the closed position easily, and the locked state is not released so easily. That is, disorder of the lock mechanism 7 can be prevented and it is ensured the lock mechanism functions correctly.

Further, according to the embodiment, the convex portion 13 is secured to the tip end portion of the latch arm 9 which is rockably secured to the openable cover 5 and extends toward the housing 3. Therefore, the convex portion 13 and the concave portion 11 can be engaged with the latch arm 9 being flexurally deformed. With this configuration, the convex portion 13 and the concave portion 11 can be firmly engaged by the elastic force which is generated in association with the flexural deformation of the latch arm 9.

According to the embodiment, there are provided a plurality of lock mechanisms 7, which are arranged in the direction parallel with the rocking axis of the openable cover 5 at a predetermined distance therebetween. Since a plurality of locking mechanisms 7 are employed, it is ensured that the closed state of the openable cover 5 is maintained.

Further, according to the embodiment, as the guide member 17 is provided at a central position, in the direction parallel with the rocking axis of the openable cover 5, between the adjoining two convex portions 13. With this configuration, it is ensured that a plurality of convex positions 13 are displaced in association with the displacement of the guide member(s) 17.

According to the embodiment, the plurality of lock mechanisms are configured such that the same function is executed at the same time. Therefore, the plurality of the lock mechanisms 7 have the same components which have the same shape and size. Thus, productivity of the lock mechanisms is raised according to the embodiment.

As mentioned above, in known conventional art, two lock mechanisms have different configurations (one is made easier to lock than the other). In such a case, the two lock mechanisms should have different structures and it is difficult to raise the productivity in comparison with the above-described embodiment.

According to the embodiment, the axis of the rocking movement of the openable cover 5 is arranged on a lower side of the openable cover 5, and the latch arms 9 are provided on the upper side of the openable cover 5. Further, in the closed state, the convex portions 13 are located below the concave portions 11. Therefore, the separating force can be applied to the convex portions 13 and the latch arms 9 with use of the gravity force acting on the convex portions 13 and the latch arms.

Therefore, it is possible to apply the separating force to the convex portion 13 stably. Even if the torsion spring 15 is omitted or the torsion spring 15 does not work correctly, the gravity force is used as the separating force, which makes it possible that the lock mechanism 7 operates stably.

Further, according to the embodiment, since the torsion spring 15 is provided to apply an elastic force, which is a force directed to separate the convex portion 13 from the concave portion 11, to the guide member 17, it is ensured that the separating force acts on the convex portion 13.

According to the first embodiment described above, a plurality of lock mechanisms 7 are provided. It should be noted that the lock mechanism 7 may be one as described below as a second embodiment. Specifically, according to the second embodiment, the lock mechanism is provided at one end side, in the direction of the axis of the rocking movement of the openable cover 5 (see FIG. 6A) and the guide member 17 and the latch arm 9 are formed integrally as shown in FIG. 6B.

Figures 6A, 6B:
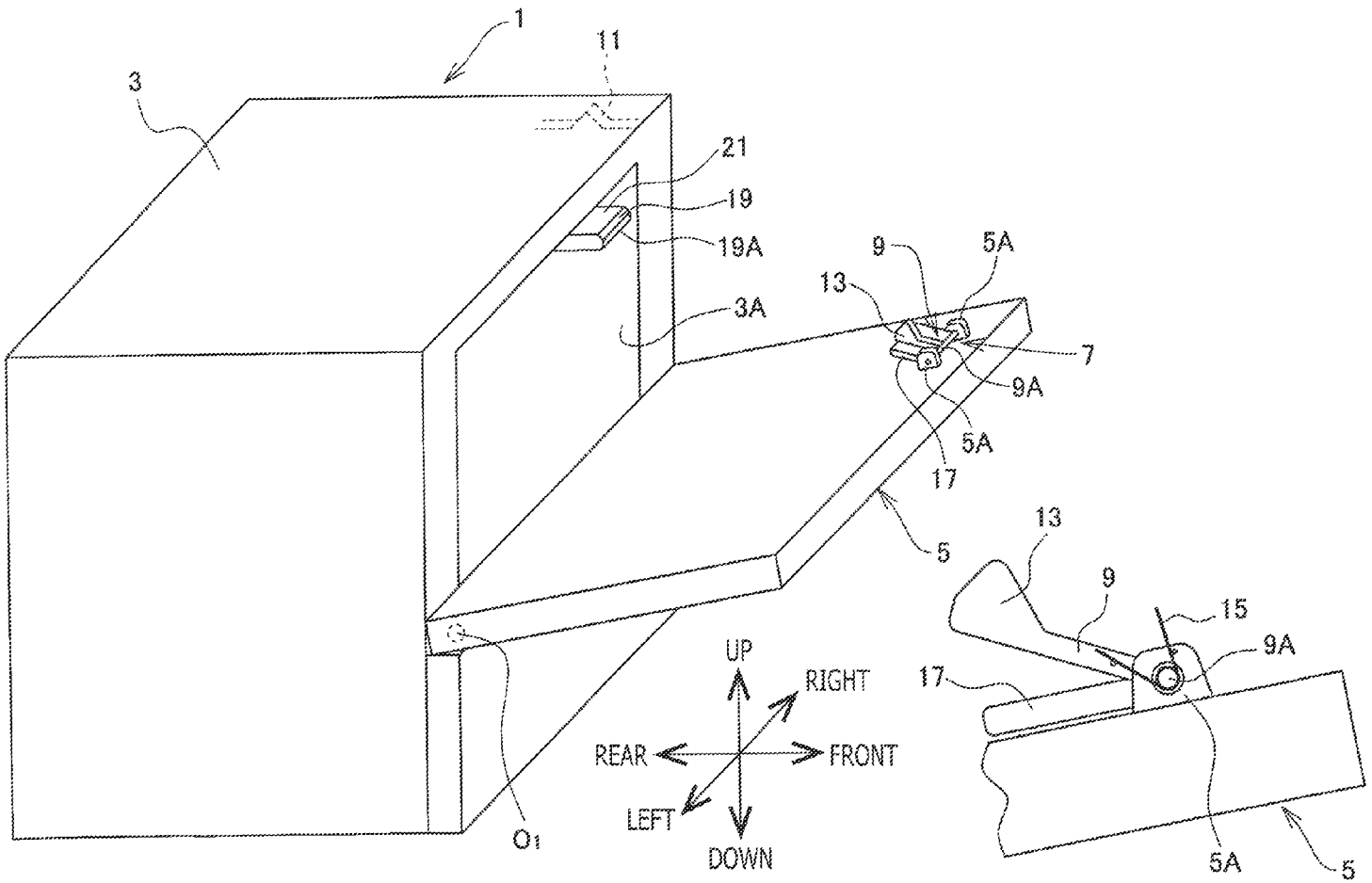
FIG. 6A is a perspective view of an image formation apparatus according to a second embodiment.
FIG. 6B is an enlarged side view of a latch arm according to the second embodiment.

In FIG. 6A, the lock mechanism is provided at one axial end portion. The position of the lock mechanism 4 needs not be limited to the one axial end portion. Alternatively, the lock mechanism 7 may be provided to the other axial end portion, or a central portion in the axial direction.

The invention needs not be limited to the configurations described above, but modified in various ways. For example, the convex portion 13 is provided to the housing 3 and concave portion 11 is provided to the openable cover 5.

According to the above-described exemplary embodiments, the convex portion is provided to the openable cover, and the concave portion 11 is provided to the housing 3. Such a configuration may be modified so that the convex portion 13 and the concave portion 11 are provided to the openable cover 5 and the housing 3, respectively.

In the exemplary embodiments, the axis of the rock movement of the openable cover 5 is defined at the lower end portion of the openable cover 5, and the latch arms etc. are provided to the upper end portion of the openable cover 5. The invention should not be limited to such a configuration, and the openable cover 5 may rock about an axis which is defined to be located at the left end, right end or upper end portion of the openable cover 5.

In the exemplary embodiments, the convex portion 13 is engaged with the concave portion 11 making use of the flexure of the latch arm 9. However, the invention needs not be limited to this configuration. For example, torsional deformation of the rocking shaft 9A can be used with increasing the rigidity of the latch arm 9, or flexure deformation of the guide member 17 may be used.

In the exemplary embodiments, a torsion spring 15 is employed. However, the invention needs not be limited to this configuration, and any other type of spring may be used.

In the exemplary embodiments, the invention is applied to the lock mechanism of the openable cover 5. However, the invention needs not be limited to such a configuration, and may be applied to other rockable members.

In the exemplary embodiments, the invention is applied to the image formation apparatus employing the electrophotographic image formation apparatus. However, the invention needs not be limited to such a configuration, and may be applied to image formation apparatuses of other types.

What is claimed:

1. An image formation apparatus, comprising:

a housing;

a rockable member rockably secured to the housing;

a lock mechanism including an engaging portion and an engageable portion, the engaging portion being formed to one of the housing and the rockable member, the engageable portion being formed to the other of the housing and the rockable member, the engageable portion being engageable with the engaging portion, the engageable portion being displaceable with respect to the other of the housing and the rockable member, a separating force which causes the engageable portion to displace from the engaging portion being applicable to the engageable portion, the rockable member being locked with respect to the housing when the engageable portion is engaged with the engaging portion;

a guide member secured to the other of the housing and the rockable member, the guide member being displaceable, with respect to the other of the housing and the rockable member, integrally with the engageable portion; and a guiding member provided to the one of the housing and the rockable member, the guiding member slidably contacting the guide member to displace the guide member with respect to the other of the housing and the rockable member when the rockable member rocks so that the state of the rockable member is changed from a rockable state to an unrockable state, wherein the engageable portion is displaced to move closer to the engaging portion in a case where the guide member contacts the guiding member than in a case where the guide member does not contact the guiding member, and wherein the guide member and the engageable portion are configured such that, when the state of the rockable member changes from the rockable state to the unrockable state, the guide member contacts the guiding member and the engageable portion displaces integrally with displacement of the guide member relative to the other one of the housing and the rockable member.

2. The image formation apparatus according to claim 1, wherein, when the guide member does not contact the guiding member, the engageable portion is spaced from the engaging portion, and wherein, when the state of the rockable member is changed from the rockable state to the unrockable state and the guide member starts contacting the guiding member, the engageable portion and the engaging portion contact and start engaging.

3. The image formation apparatus according to claim 1, wherein the engageable portion is formed at a tip end side of an elastically-deformable arm, the elastically-deformable arm being rockably secured to the other of the housing and the rockable member and extending toward the one of the housing and the rockable member.

4. The image formation apparatus according to claim 1, further comprising a plurality of lock mechanisms arranged at intervals in a direction parallel with an axis of a rocking movement of the rockable member.

5. The image formation apparatus according to claim 4, wherein the guiding member is arranged at a central position between two adjoining engageable portions along the direction parallel with the axis of the rocking movement of the rockable member.

6. The image formation apparatus according to claim 4, wherein the plurality of lock mechanisms are configured to operate substantially simultaneously.

7. The image formation apparatus according to claim 1, wherein a center of a rocking movement of the rockable member is defined at a lower end portion of the rockable member, while one of the engageable portion and the engaging portion is formed at an upper end portion of the rockable member, and wherein the engageable portion is located below the engaging portion when the rockable member is in the unrockable state.

8. The image formation apparatus according to claim 1, further comprising a spring member configured to apply an elastic force that urges the engageable portion to separate from the engaging portion.

9. The image formation apparatus according to claim 1, wherein the engaging portion is formed on the housing and the engageable portion is formed on the rockable member.

10. An image formation apparatus, comprising:

a housing having an opening;

an openable cover member rockably secured to the housing to open/close the opening;

a lock mechanism including an engaging portion and an engageable portion, the engaging portion being formed to the housing, the engageable portion being formed to the cover member, the engageable portion being displaceable with respect to the cover member, a separating force which causes the engageable portion to displace from the engaging portion being applicable to the engageable portion, the cover member being locked with respect to the housing to close the opening when the engageable portion is engaged with the engaging portion;

a guide member secured to the cover member, the guide member being displaceable, with respect to the cover member, integrally with the engageable portion; and a guide surface provided to the housing, the guide member slidably-contacting the guide surface and being displaced with respect to the cover member when the cover member rocks so that the state of the cover member is changed from a rockable state to an unrockable state, wherein the engageable portion is displaced to move closer to the engaging portion in a case where the guide member contacts the guiding member than in a case where the guide member does not contact the guiding member, and wherein the guide member and the engageable portion are configured such that, when the state of the cover member changes from the rockable state to the unrockable state, the guide member contacts the guide surface and the engageable portion displaces integrally with displacement of the guide member relative to the other one of the housing and the rockable member.

* * * * *